US007810423B2

(12) United States Patent
Monroe

(10) Patent No.: US 7,810,423 B2
(45) Date of Patent: Oct. 12, 2010

(54) GAS OPERATED FIREARM ACTION DELAY DEVICE

(76) Inventor: Christopher Alan Monroe, 15030 Torrey Pines Cir., Chowchilla, CA (US) 93610

( * ) Notice: Subject to any disclaimer, the term of this patent is extended or adjusted under 35 U.S.C. 154(b) by 406 days.

(21) Appl. No.: 12/036,171

(22) Filed: Feb. 22, 2008

(65) Prior Publication Data

US 2010/0224056 A1 Sep. 9, 2010

(51) Int. Cl.
*F41A 9/00* (2006.01)

(52) U.S. Cl. ..... 89/193

(58) Field of Classification Search ..... 89/193, 89/194, 191.02, 192, 130, 191.01, 168, 169, 89/174–176, 181, 188–190
See application file for complete search history.

(56) References Cited

U.S. PATENT DOCUMENTS

| | | | | | |
|---|---|---|---|---|---|
| 544,661 | A | * | 8/1895 | Browning | 89/193 |
| 572,771 | A | * | 12/1896 | Richmond | 89/126 |
| 1,713,955 | A | * | 5/1929 | Destree | 89/192 |
| 2,560,292 | A | * | 7/1951 | Kauch | 89/192 |
| 2,865,256 | A | * | 12/1958 | Marsh | 89/191.02 |
| 2,895,383 | A | * | 7/1959 | Reed | 89/193 |
| 3,051,057 | A | * | 8/1962 | Ivy | 89/193 |
| 3,329,064 | A | | 7/1967 | Segrest | |
| 3,595,129 | A | * | 7/1971 | Bender et al. | 89/130 |
| 4,015,512 | A | | 4/1977 | Feerick | |
| 4,141,166 | A | | 2/1979 | Schultz | |
| 4,409,883 | A | * | 10/1983 | Nyst | 89/192 |
| 5,388,500 | A | * | 2/1995 | Petrovich | 89/194 |
| 5,465,518 | A | | 11/1995 | Blaser | |
| 5,768,818 | A | * | 6/1998 | Rustick | 42/75.02 |
| 6,079,138 | A | * | 6/2000 | Meaker | 42/17 |
| 6,343,429 | B1 | | 2/2002 | Mossberg et al. | |
| 6,510,639 | B2 | | 1/2003 | McMoore | |
| 6,606,934 | B1 | | 8/2003 | Rock et al. | |

* cited by examiner

*Primary Examiner*—Michael Carone
*Assistant Examiner*—Reginald Tillman, Jr.
(74) *Attorney, Agent, or Firm*—Glen L Gross; Shlesinger, Arkwright & Garvey LLF

(57) ABSTRACT

The invention relates to a device for delaying the gas action operated firearm. The device includes a gas chamber and an outlet, wherein the outlet is in fluid communication with the action tube of the firearm. The device has a port in fluid communication between the gas chamber and the barrel and a one-way check valve in the port. A gas release valve is included and is disposed on the container and in fluid communication with the gas chamber and the outlet. The device further includes linkage attached to the gas release valve and in mechanical communication with the bolt, such that when the gas release valve is in the closed position, gas is retained in the gas chamber and the linkage blocks the bolt from moving, and when the gas release valve is in the open position the linkage unblocks the bolt permitting normal gas action of the firearm.

23 Claims, 9 Drawing Sheets

GAS OPERATED FIREARM ACTION DELAY DEVICE

BACKGROUND OF THE INVENTION

1. Field of Invention

The present invention is related to the field of gas action operated firearms, and gas action operated rifles in particular.

2. Description of Related Art

In the use of firearms, accuracy and the rate of fire are highly valued qualities in a rifle. In general, to increase the accuracy of a rifle, the rate of fire is generally reduced. A key to increasing accuracy is to reduce the movement of the rifle during the firing of the weapon.

The most accurate rifles today are bolt action rifles. Bolt action rifles fire only one round or cartridge at a time. The bolt locks a cartridge or round into the chamber of the rifle and the only movement after firing the cartridge is the motion of the bullet down the barrel and the subsequent recoil. A shooter must now manually reload the rifle. This manual reload of bolt action rifles, while accurate, reduces the rate at which they can fire.

After a bolt action rifle is fired, a shooter must release part of the rifle with one hand to operate the bolt and load another round in the chamber. This manual reload slows down the rate of fire in bolt action rifles. Additionally, the letting go of the rifle requires the shooter to re-acquire the target, again, delaying the process and further lessening the rate of fire, To increase the rate of fire on a conventional bolt action rifle, automatic or semi-automatic rifles have been designed in the past, wherein the manual movement of the bolt has been automated or semi-automated by use of the expanding gases created when the round is detonated. Semi-automatic rifles use the recoil and the gases produced by the firing of the cartridge to actuate the action of discharging the spent round and reloading another round. The action of a semi-automatic rifle allows the shooter to maintain both hands on the rifle, but accuracy is sacrificed due to the movement of internal mechanisms that make-up the automation prior to the bullet leaving the barrel.

To take advantage of the increase firing rate of the semi-automatic rifle and the accuracy of the bolt action rifle, devices have been manufactured to delay the semi-automatic portion of firing a rifle. Conventional delaying mechanisms employ the use of springs, pistons or a combination of both. Conventional delaying devices transfer the energy of the expanding gases into a mechanical energy stored in the spring or piston. The mechanical energy is released by the shooter or by an automatic timed release to allow the action of reloading the rifle to occur.

A deficiency with conventional delay devices of semi-automatic rifles is the requirement of the mechanical systems. These mechanical systems, the springs and or pistons add weight to the rifle. This added weight makes aiming the rifle harder, thereby reducing accuracy.

Still another deficiency with conventional delay devices is that the mechanical systems require extensive cleaning to remove the carbon build up. Without the cleaning, the smooth operation required of the springs and pistons is compromised and the device can more readily jam.

Additionally, springs and pistons of conventional delay devices have a fatigue life expectancy and must be replaced to keep the rifle operating properly.

SUMMARY OF THE INVENTION

It is an object of the present invention to overcome the drawbacks and shortcomings of conventional delay devices for semi-automatic rifles. This present invention provides for the increased accuracy while maintaining a high rate of fire.

The present invention provides the capability to delay the action of semi-automatic rifle by capturing the expanding gases created by the detonation of the round.

The present invention captures the gases and stores the gases in a chamber until released by the shooter. When released, the gases operate the bolt action normally without the use of mechanical devices.

Further, the present invention reduces the weight of conventional delayed action semi-automatic rifles by eliminating the need for heavy mechanical mechanisms such as springs or pistons.

Additionally, the present invention increases the reliability of delayed action semi-automatic rifles by having fewer moving parts that require extensive cleaning and maintenance.

This invention overcomes the drawbacks and shortcomings of the prior art conventional devices and systems.

The present invention is a device for delaying the action of a gas action operated firearm having a barrel with a bore, an action tube and a bolt block. The device comprises a container having a gas chamber and an outlet, wherein the outlet is in fluid communication with the action tube of the firearm. The device also includes a port in fluid communication between the gas chamber and the bore of the barrel and a one-way check valve in the port, wherein the one-way check valve permits the fluid flow from the bore to the gas chamber. Further, the device includes a gas release valve having at least an open and closed position, disposed on the container and in fluid communication with the gas chamber and the outlet. Also included in the device is linkage rotatably attached to the gas release valve and in mechanical communication with the bolt block, wherein when the gas release valve is in the closed position, gas is retained in the gas chamber and the linkage blocks the bolt block from moving. When the gas release valve is in the open position the linkage unblocks the bolt block permitting normal gas action of the firearm.

In an alternative embodiment, the present invention is gas action delay device, comprising a container having a gas chamber, an output port and an input port, wherein the input port includes a one-way check valve and is operably configured to receive a gas input. Additionally, the device includes a valve disposed on the container, having at least an open and closed position, and being in fluid communication with the output port and the gas chamber, wherein when the valve is in the closed position, gas is retained in the gas chamber and when the valve in the second position, the gas is released through the output port. The device further includes linkage having a first and second end, wherein the first end is rotatably attached to the valve. Also the device includes a blocking member in mechanical communication with the second end of the linkage and having at a first and second position, wherein when the valve is in the closed position, the blocking member is in a blocking position and when the valve is in the open position, the blocking member is rotated by the linkage to an unblock position.

Still further, the present invention is an action delayed device for attaching to a gas action operated semi-automatic rifle having a barrel, an action tube, a bolt breach assembly and a receiver assembly comprising a gas capture chamber disposed on the barrel, a port in fluid communication between the gas capture chamber and the barrel, and a one-way check valve in the port, wherein the one-way check valve permits the gas flow from the barrel to the gas capture chamber. Further included is a gas release valve having an open and closed position disposed on the gas capture chamber, a nozzle disposed on the gas release valve, and a gas line attached to the nozzle and in fluid communication with the action tube of the rifle. A linkage assembly having first and second ends is included, wherein the first end is rotatably attached to the gas release valve. A bolt delay mechanism disposed on the receiver assembly and rotatably attached to the second end of the linkage assembly, wherein when the gas release valve is in the closed position, the bolt delay mechanism is in a bolt breach assembly delay position and when the gas release valve is in the open position, the bolt delay mechanism is rotated by the linkage to a bolt breach assembly free position permitting the bolt breach assembly to execute normal action.

Continuing, the present invention includes a rifle that comprises a stock, a receiver assembly connected to the stock, wherein the receiver assembly includes a gas activated bolt breach assembly having an action tube, and a trigger assembly. The rifle also includes a bolt block assembly disposed on receiver assembly and a barrel connected to the gas activated bolt breach assembly. Included on the rifle is a gas chamber disposed on the barrel, a port in fluid communication between the gas chamber and the barrel and a one-way check valve in the port, wherein the one-way check valve permits the fluid flow from the barrel to the gas chamber. Additionally, a gas release valve disposed on the gas chamber and a nozzle disposed on the gas release valve and in fluid communication with the action tube of the gas activated bolt breach assembly are included. The rifle further includes a linkage assembly having first and second ends, wherein the first end is rotatably attached to the gas release valve. Still further, included in the device is a bolt delay mechanism disposed on the receiver assembly and rotatably attached to the second end of the linkage assembly, wherein when the gas release valve is in the closed position, the bolt delay mechanism is in a bolt breach assembly delay position and when the gas release valve is in the open position, the bolt delay mechanism is rotated by the linkage to a bolt breach assembly free position permitting the gas activated bolt breach assembly to execute normal action.

These and other features and advantages of this invention are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein.

DETAILED DESCRIPTION

Figure 1:
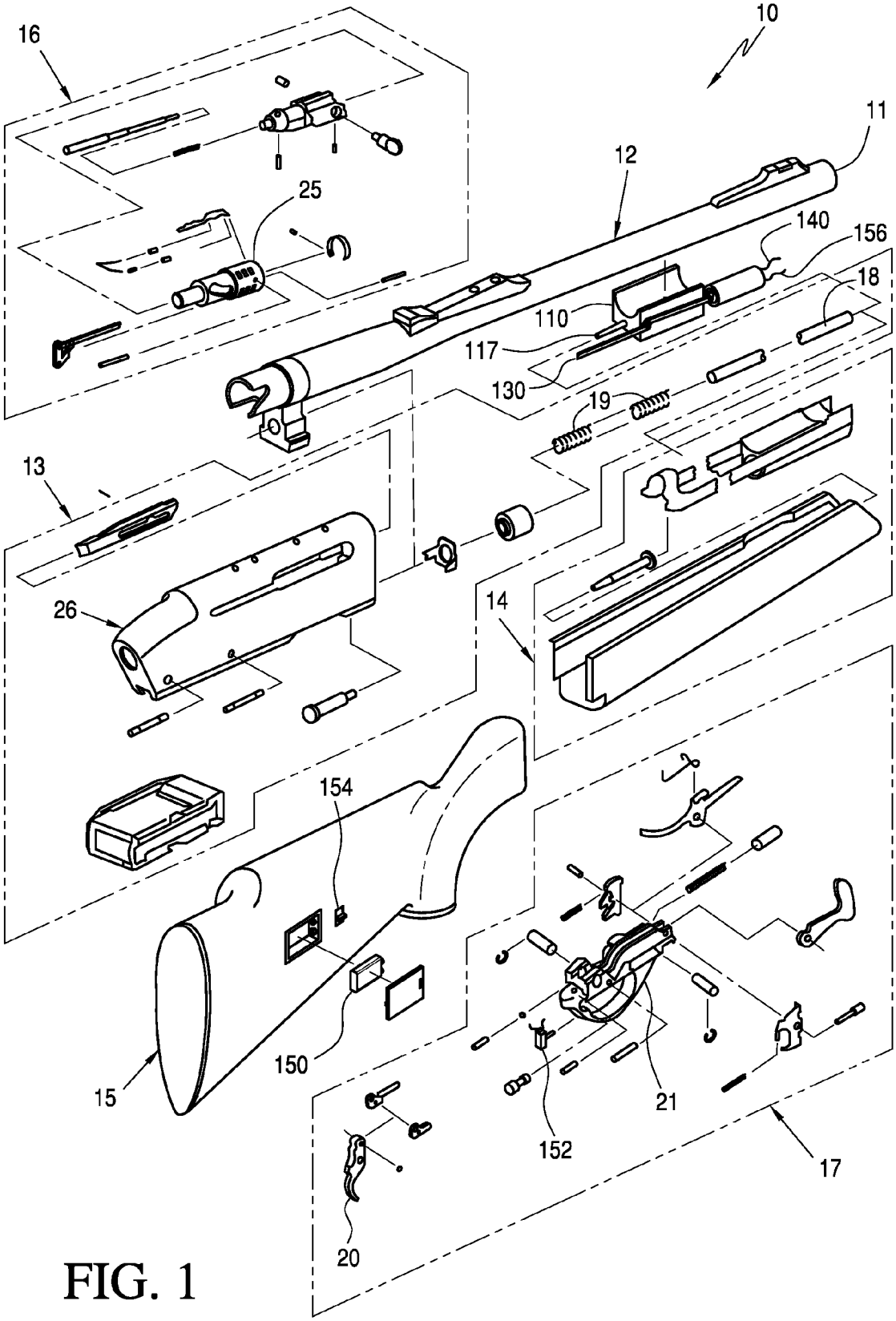
FIG. 1 is an exploded perspective view of a device made in accordance with this invention.
Figure 2:
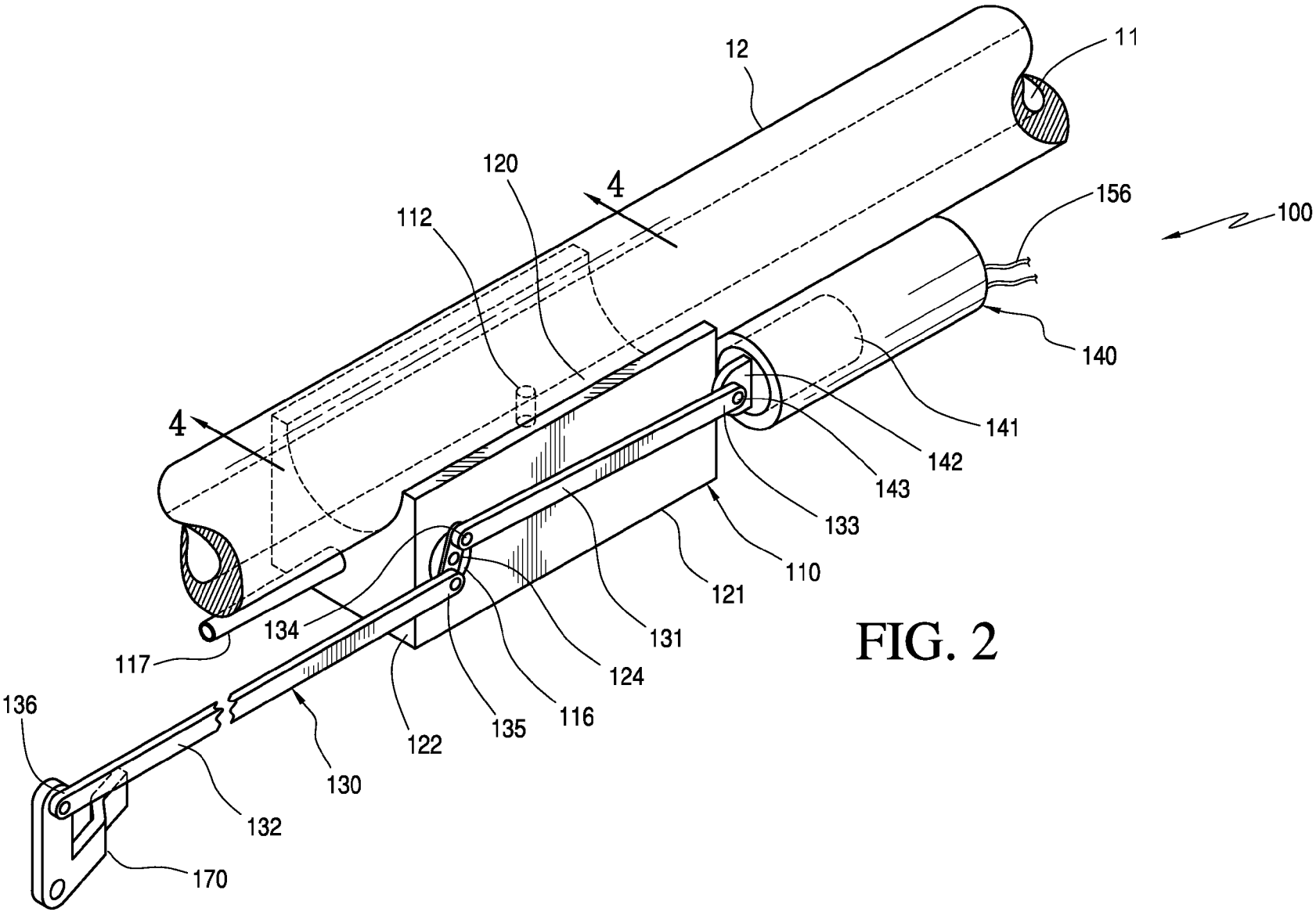
FIG. 2 is a detailed perspective view of the device of FIG. 1.
Figure 3:
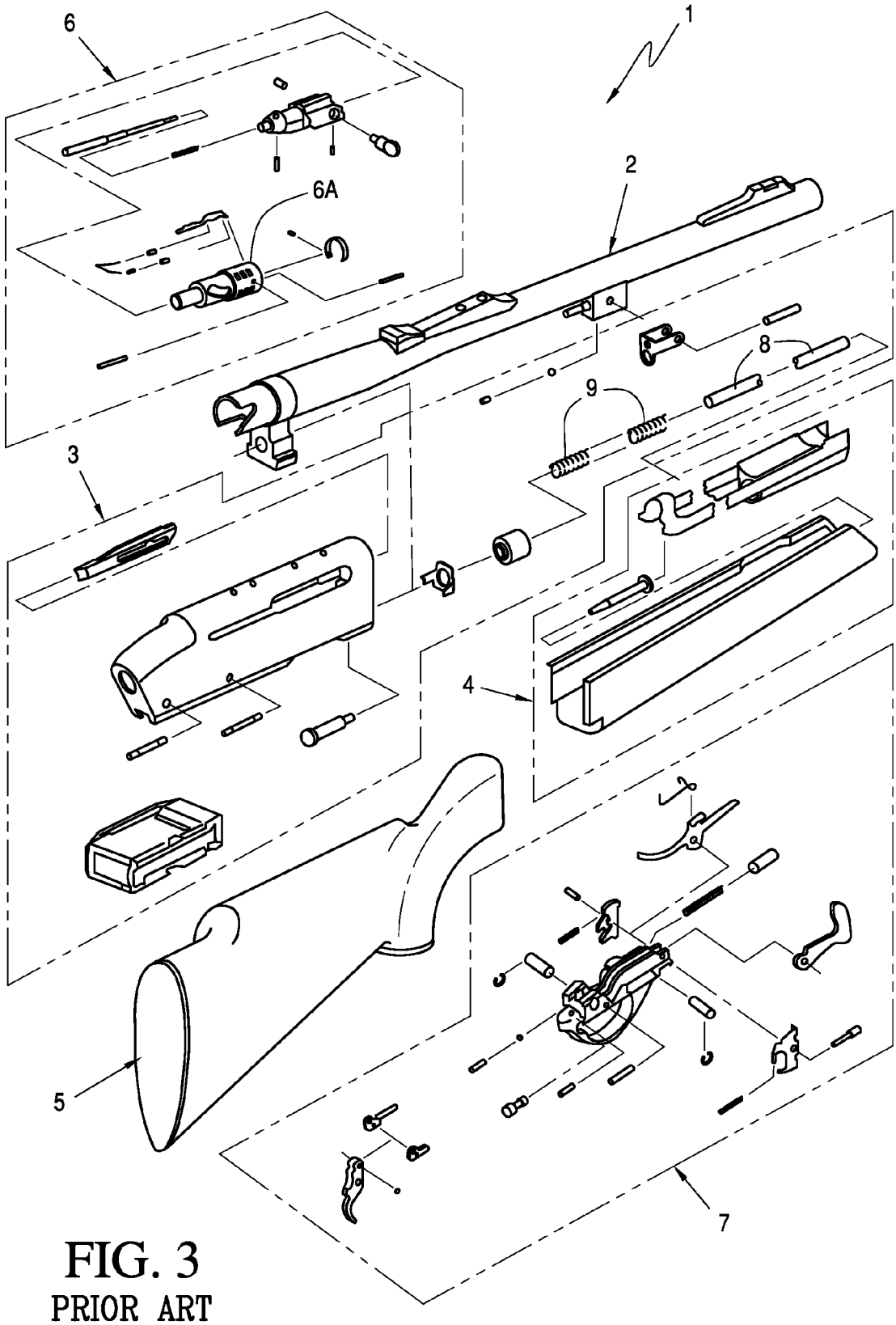
FIG. 3 PRIOR ART
FIG. 3 is an exploded perspective view of a prior art gas operated semi-automatic rifle.

FIG. 1 is an exploded perspective view of a gas operated delay action rifle 10, made in accordance with the present invention. FIG. 2 is a detail view of action delay assembly 100 of the rifle 10, made in accordance with the present invention. FIG. 3 is a conventional gas operated action semi-automatic rifle 1 detailing common components. The conventional gas operated semi-automatic rifle 1 of FIG. 3 comprises items common to most semi-automatic rifles, such as a barrel 2, a receiver assembly 3, a fore-end assembly 4, and a stock 5. Other items common to conventional semi-automatic rifles are a breach bolt assembly 6, an action port tube 8 and an action spring 9 disposed within the receiver assembly 3. Further, the conventional rifle 1 in FIG. 1 includes a trigger assembly 7. When a shooter fires the conventional rifle 1 shown in FIG. 3, the rapidly expanding gases created by the ignition of gun powder in a cartridge pushes a bullet out of the barrel 2. The gases also are ported through the action port tube 8 to the breach bolt assembly 6. A bolt 6A within the breach bolt assembly 6 is retracted, pushed towards the shooter or rear of the rifle 1, and the spent cartridge is ejected. Additionally, as the breach bolt assembly 6 travels reward, the action spring 9 is compressed. Once the gas pressure has reduced to a level less than the force exerted by the compressed action spring 9, the action spring 9 returns the breach bolt assembly 6 back, which in turn engages and loads the next cartridge. This process is called in summary "the Action."

To improve the accuracy of the conventional gas operated semi-automatic rifle 1, the Action would have to be stopped preventing the breach bolt assembly 6 from traveling reward and ejecting the spent cartridge. By stopping the Action at this point, the movement of the rifle 1 caused by the firing is reduced, and would allow the shooter to maintain the sights on a target.

The gas operated delay action rifle device 10, made in accordance with the present invention, as shown in FIG. 1 includes some of the same major assemblies as in the conventional rifle 1. For instance, the rifle 10 includes a barrel 12 having a bore 11, a receiver assembly 13, a fore-end assembly 14, a stock 15, a breach bolt assembly 16, a trigger assembly 17, an action port tube 18 and an action spring 19 disposed within the receiver assembly 13 and enclosed by the receiver housing 26. The rifle 10 further includes an action delay assembly 100. FIGS. 1, 2 and 4 through 6, show an exemplary embodiment of the components of the action delay assembly 100, made in accordance with the present invention.

The action delay assembly 100 is designed to selectively stop the Action preventing the breach bolt assembly 16 from traveling towards the shooter or reward. The action delay assembly or device 100 as shown in FIG. 2 includes a container or housing 110, a linkage assembly 130, a solenoid 140 and a breach bolt block assembly or blocking member 170. The container 110 in the present embodiment includes a gas chamber 111 and constructed out of steel. While the present embodiments of the Figures shows the action delay assembly 100 in use with the rifle 10, it should be appreciated that the action delay assembly may be installed on other firearms, such as but not limited to, pistols and shotguns. Further, it should be appreciated that in other various exemplary embodiments the container may be constructed out of other materials common in the art of making gas chambers.

Figure 7:
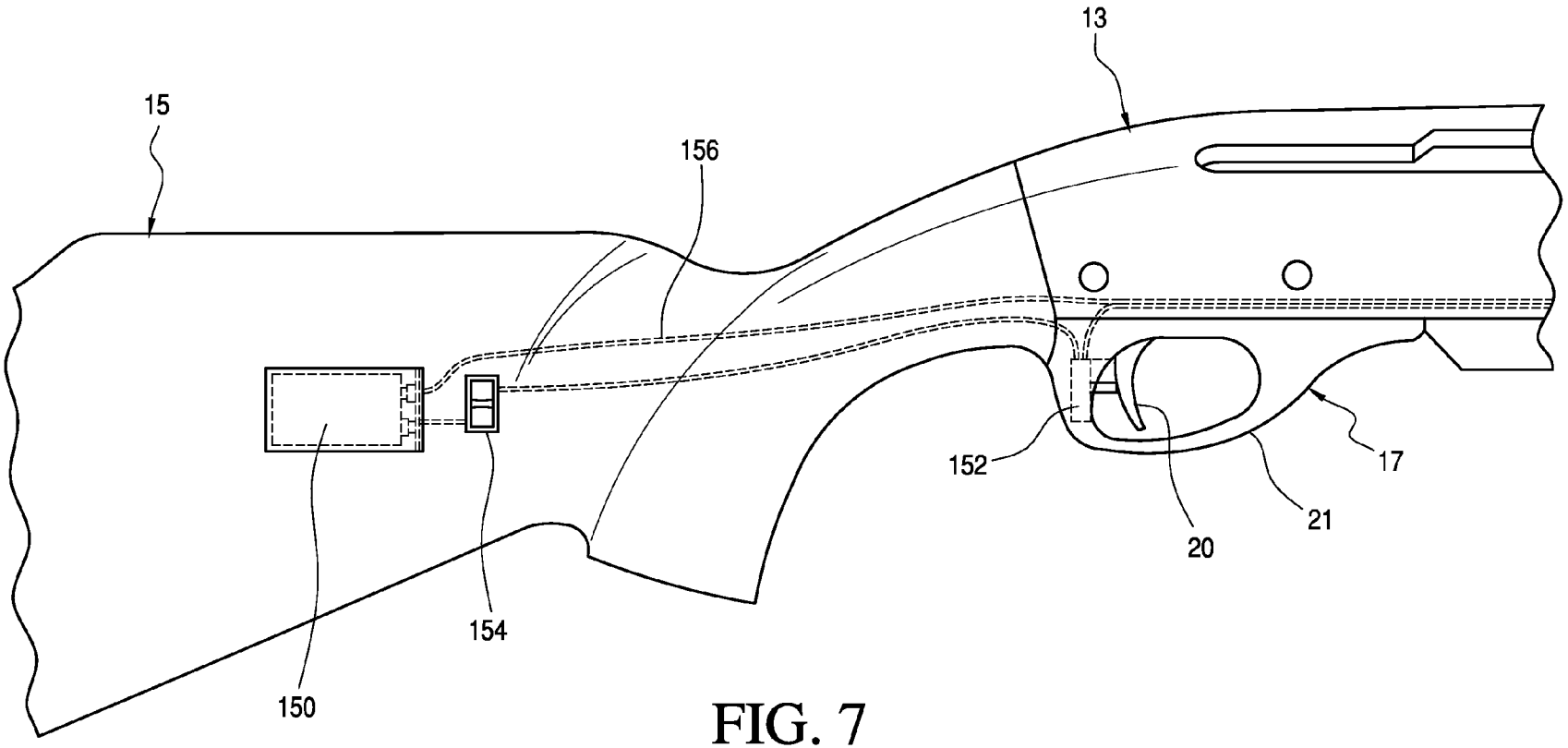
FIG. 7 is a detailed side view of a stock of the rifle in FIG. 1, a power supply and a micro switch of the device of FIG. 2.

The action delay assembly 100 further includes a power supply 150, a micro switch 152, an on/off switch 154 and electrical wires 156 from the power supply 150 to the micro switch 152 and the solenoid 140 as shown in FIGS. 1, and 7.

Figures 4, 5:
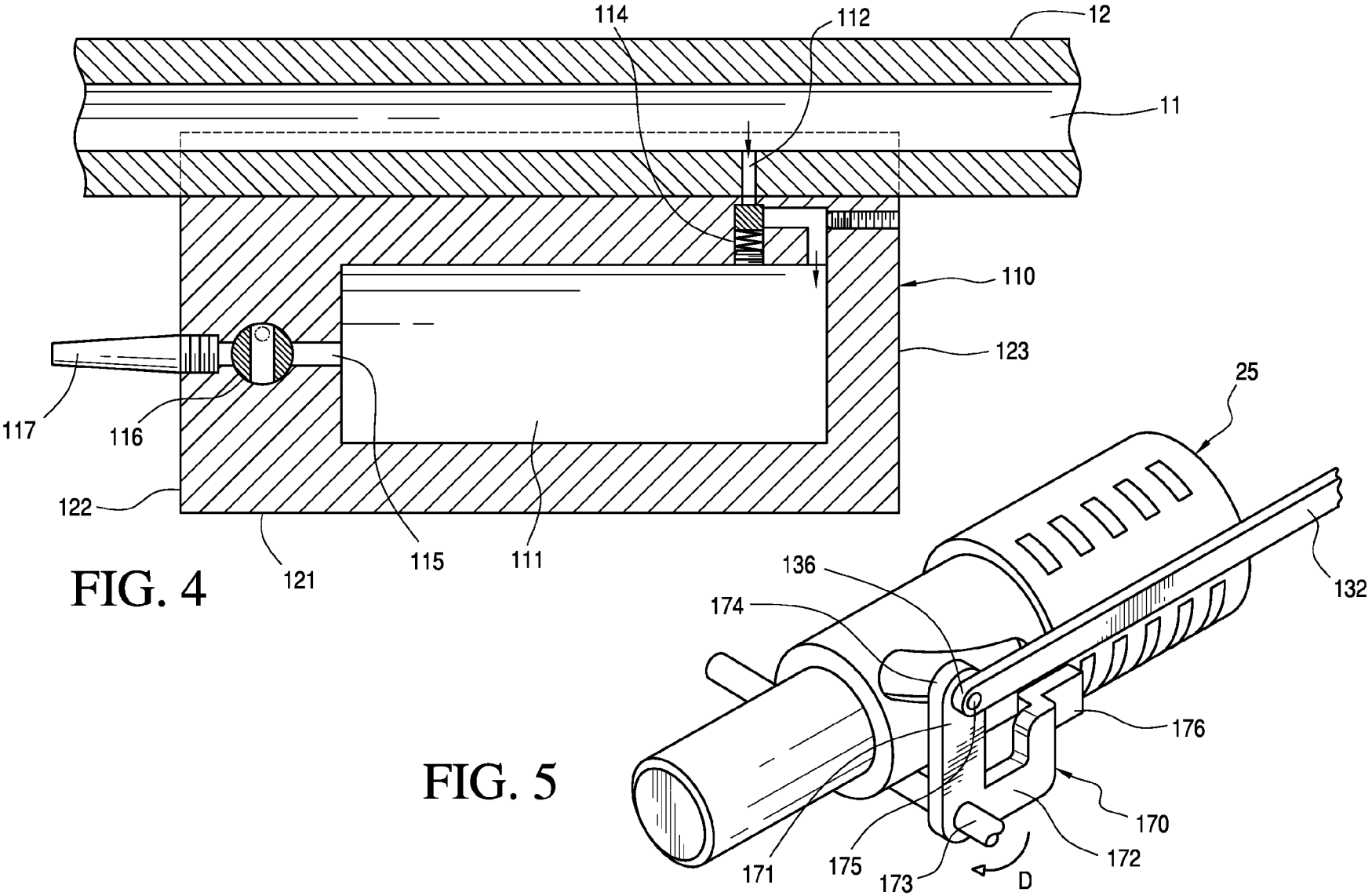
FIG. 4 is cross-sectional view of a high pressure chamber of the device in FIG. 2 taken along line 4-4 in FIG. 2.
FIG. 5 is a detailed perspective view of a breach bolt of the rifle of FIG. 1 and a breach bolt block of the device in FIG. 2.

FIG. 4 is a cross-sectional view of the container or housing 110 of the device 100. The container 110 further includes a input or port 112 and disposed within the port 112 is a one way valve or check valve 114. The port 112 is also called a barrel port and is in fluid communication between the rifle bore 11 and the gas chamber 111. In the present embodiment, the port 112 is aligned with the check valve 114 and allows the gasses caused by the firing of the cartridge into the chamber 111. The arrows in FIG. 4 depict the direction of travel for the expanding gas fluid. It should be appreciated that in other various exemplary embodiments, the port is not aligned with the check valve and the port could be connected to the check valve by plumbing conduit common in the art. The one way valve 114 limits the fluid communication within the barrel port 112 to only flow in the direction from the bore 111 to the chamber 110. In this manner, gas will flow out of the bore 11 and into the chamber 111, but not back into the bore 11 from the chamber 111.

In the present embodiment, the check valve 114 is a piston and spring type check valve. It should be appreciated that in other various exemplary embodiments, other types of check valves may be used, for example a spring-ball type check valve.

The container 110 further includes an outlet port 115 and a gas release valve 116. The outlet port 115 is in fluid communication with the exterior of the chamber 110. The release valve 116 is disposed in the outlet port 115 and has two positions; a first or closed position and a second or open position. The release valve 116 is switched between the first and the second positions by the linkage assembly 130 (see FIGS. 2 and 6). In the present embodiment, the gas release valve is normally in the open position, wherein the gas from the chamber 111 is free to exit the chamber 111 and enter the nozzle 117, until the release valve 116 is moved to the first or closed position.

Figure 6A:
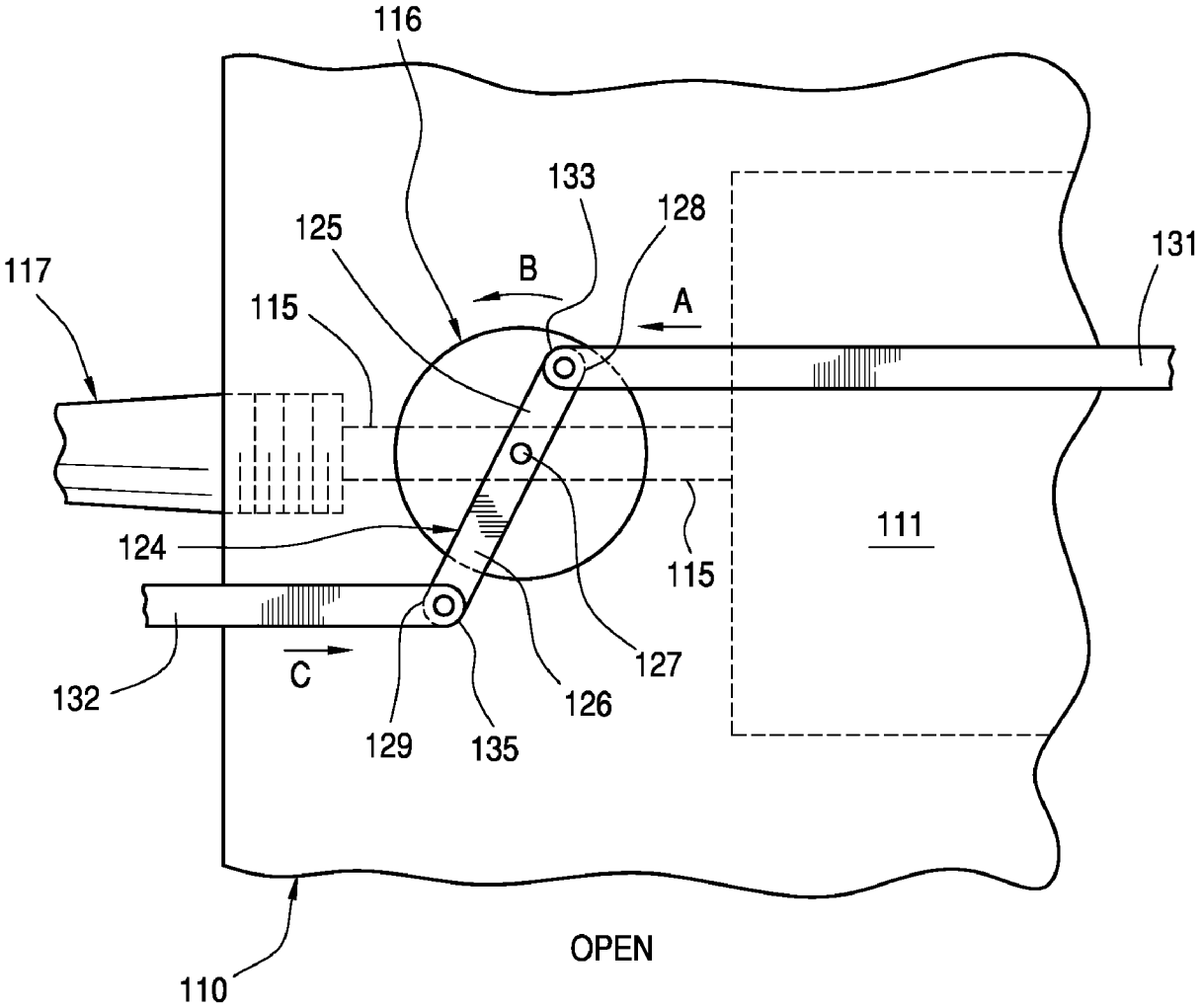
FIG. 6A is a detailed view of a gas release valve and linkage assembly of the device in FIG. 2 in an opened position.

In the present embodiment, the release valve 116 is a rotatable ball valve. However, it should be appreciated that in other various exemplary embodiments the release valve could be of other designs common in the art, such as, but not limited to, a shuttle valve. Further, the valve 116 includes a lever member or rotating arm 124. The lever 124 is connected to the valve 116 at attachment point 127. In the present embodiment the lever 124 is a unitary piece of material that attaches to the valve 116 in a fixed position and having a first and second distal ends, 128 and 129. The first distal end 128 has a moment 125 and the second distal end 129 has a moment 126, as shown in FIG. 6A. In the present embodiment, moment 125 is shorter than the moment 126. However, it should be appreciated that in other various exemplary embodiments, the lever member could be two separate arms attached to the release valve 116.

The container 110 further includes a nozzle 117. The nozzle 117 is removably attached to the exterior of the container 110 and is in fluid communication with the outlet port 116. In the present embodiment, the nozzle 117 is threaded into the container 110. However, it should be appreciated that in other various exemplary embodiments, the nozzle could be removably attached by other methods common in the art, such as, but not limited to, press fitting or gluing. Further, it should be appreciated that in other various exemplary embodiments, the nozzle could be integral to the container.

The container 110 further has a first surface 120, a second surface 121, a first end 122 and a second end 123, as shown in FIGS. 2 and 4. The first surface or top 120 conforms to the shape of the barrel 12. The second surface or bottom 121 is shaped such that it conforms to an interior of the fore-end assembly 14 commonly used on rifles for the placement of the non shooting hand of the shooter. The first end 122 is disposed generally towards the receiver assembly 13 of the rifle 10 and the second end 123 is disposed generally away from the receiver assembly 13.

The container 110 in the present embodiment is fixedly attached to the barrel 12 by welding the container 110 to the barrel 12. However, it should be appreciated that in other various exemplary embodiments, the container could be removably attached to the barrel by methods common in the art, such as but not limited to, removable fasteners or straps. Further, it should be appreciated that in other various exemplary embodiments, the container could be made from other materials such as, but not limited to stainless steel or high strength synthetic fibers, for example.

The action port tube or action tube 18 of the rifle 10 is in fluid communication between the bore 11 of the barrel 12 and the breach bolt 25. The nozzle 117 is connected to the action port tube 18, as shown in FIG. 1. The action port tube 18 in the present invention is not in fluid communication with the bore 11 when the release valve 116 is in the first or closed position, which is unlike the conventional rifle 1 and action port tube 8. Instead, the action port 18 is in the fluid communication with the chamber 110 via the nozzle 117 when the release valve 116 is in the second or open position.

It should be appreciated that in other various exemplary embodiments, the nozzle is connected to the action port tube by the use of additional plumbing in order to allow for the chamber to be disposed in other places on the rifle instead of within the fore-end assembly.

When the rifle 10 is fired, the expanding gases travel through the barrel port 112, press against and travel through the check valve 114. The gases then enter the chamber 111. The gases are stored in the chamber 111 until released by the shooter, as will be discussed further below. The check valve 114 closes once the gas pressure in the bore 11 reaches a level that is less than the check valve 114 spring force. The check valve 114, when closed, seals the barrel port 112 and locks the stored gases in the chamber 111 keeping the gases from escaping back into the bore 11.

The chamber 111 is operably configured to withstand internal gas pressures in a range of 2,000 to 3,000 psi. The embodiment of the present chamber 111 is operably configured to hold a pressure range of 2,700 to 3,000 psi. In the present embodiment the chamber 111 is integral to the container 110. However, it should be appreciated that in other various exemplary embodiments the chamber could be constructed out of other high strength, heat resistant composite compounds common in the art and not be integral with the container.

In the present embodiment the container 110 is disposed adjacent to the barrel 12 and internal to the fore-end assembly 14, as shown in FIG. 1. However, it should be appreciated that in other various exemplary embodiments, the container does not have to be internal to the fore-end assembly, the container may be disposed adjacent to the barrel, but external to the fore-end assembly.

Referring back to FIGS. 1 and 2, the linkage assembly 130 of the action delay assembly device 100 connects the solenoid 140 to the release valve 116. The linkage assembly 130 further connects the valve 116 to the breach bolt block assembly 170. The linkage assembly 130 further includes a first portion 131 and a second portion 132. The first linkage portion 131 places the solenoid 140 in direct mechanical communication with the release valve 116. The first linkage 131 includes a first end 133 and a second end 134. The first end 133 engages the output of solenoid 140. The second end 134 rotatably engages the release valve 116

The second linkage portion 132 continues the mechanical communication of the solenoid 140 to the breach bolt block or bolt delay assembly 170. The second linkage 132 includes a first end 135 and a second end 136. The first end 135 rotatably engages the release valve 116 and the second end engages the breach bolt 170.

As shown in FIG. 5, the breach bolt block assembly 170 includes a first member 171, a second member 172 and a pivot 173 as shown in FIG. 5. The first member 171 and the second member 172 are integral and form one member the breach bolt block assembly 170 and being generally L-shaped.

The first member 171 has a first end 174 and a post 175. The second end 136 of the second linkage 132 is rotatably engaged to the post 175.

The pivot 173 is rotatably attached to the receiver housing 26 of the receiver assembly 13. The second member 172 of the breach bolt block 170 includes a locking end 176. The locking end 176 engages the bolt 25 of the breach bolt assembly 16.

The breach bolt block assembly 170 has two positions, an engaged position and a non-engaged position. The breach bolt block 170, as shown in FIG. 5, is in the engaged position with the locking end 176 positioned against the bolt 25. Further, the breach bolt block 170 is operably configured to stop the reward motion of the bolt 25 when the block 170 is in the engaged position. In the present embodiment, the breach bolt block 170 is in the engaged position when the gas release valve 116 is in a closed position.

The solenoid 140 is a electromagnetic push type solenoid with a spring return and receives electrical power from the power supply 150. In the present embodiment, the solenoid 140 is disposed adjacent to the second end 123 of the container 110 as shown in FIGS. 1 and 2. However, it should be appreciated that in other various exemplary embodiments, the solenoid could be disposed at other locations such as, but not limited to, adjacent to the first end of the container.

Referring again to FIG. 2, the solenoid 140 is a conventional electrical solenoid. The solenoid 140 includes a solenoid plunger 141 and an attachment end 142. The attachment end 142 includes an attaching post 143. The first end 133 of the first linkage 131 rotatably engages the attaching post 143.

Figure 6B:
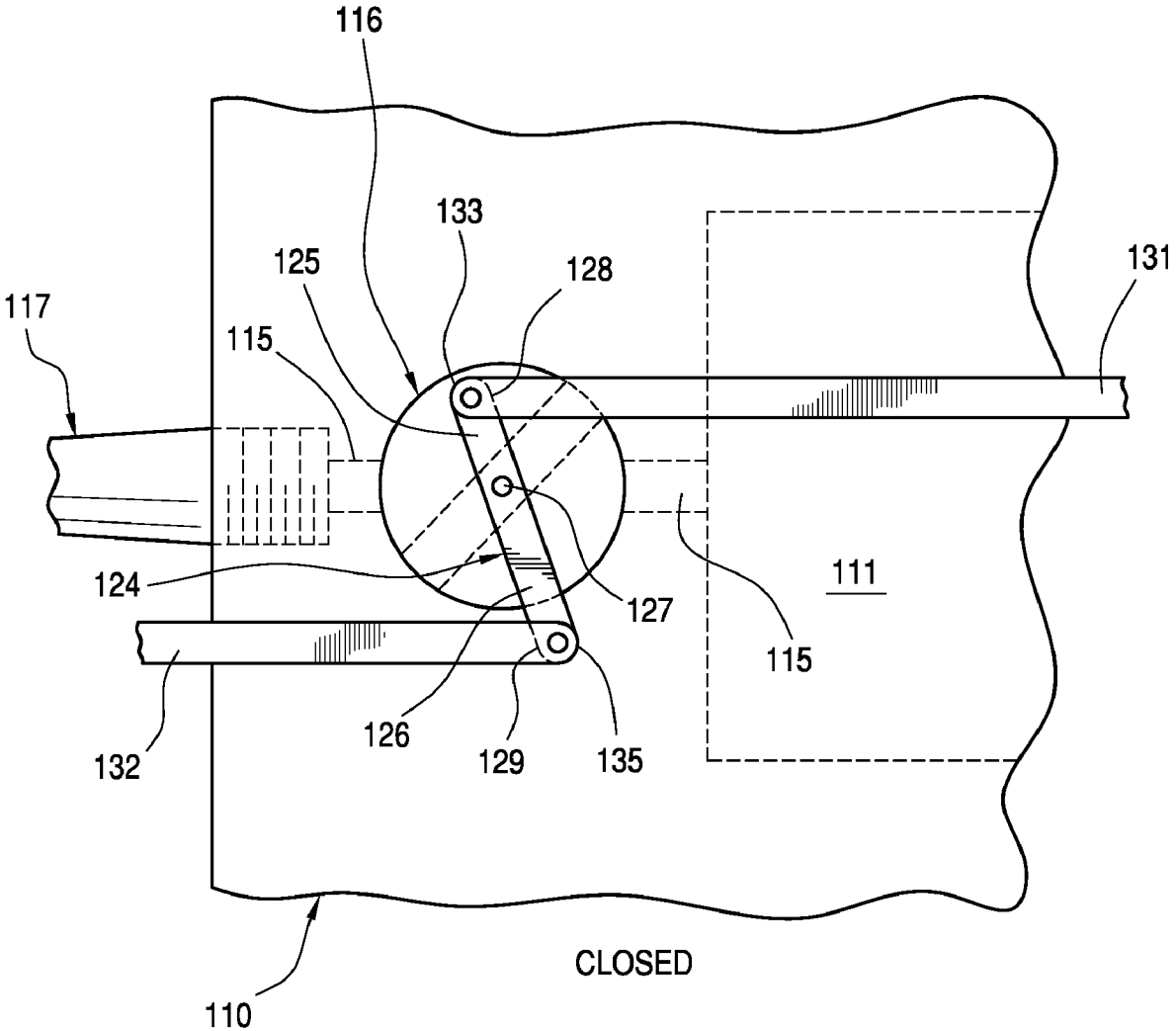
FIG. 6B is a detailed view of a gas release valve and linkage assembly of the device in FIG. 2 in a closed position.

FIG. 6A is a detailed view of the value 116 in the first or open position, showing the connection of the linkage 131 to the distal end 128 and the linkage 132 to the distal end 129 of the rotating arm 124. The movement of the linkage assembly 130 and the valve 116 for the present embodiment is described in this specification. However, it should be appreciated that in other various exemplary embodiments, the movement of the linkage and valve could be arranged in other sequences so long as the end result is the same. When the solenoid 140 activates, the linkage 131 moves in the direction of Arrow A. This movement of the linkage 131 pushes on the rotating arm 124 and in turn rotates the valve 116 counter-clockwise in the direction of Arrow B. As the valve 116 rotates to the second or closed position, as shown in FIG. 6B, the linkage 132 is moved in the direction of Arrow C by the second distal end 129 of the rotating arm 124. The movement of the linkage 132 in the direction of Arrow C causes the bolt block assembly or bolt delay assembly 170 to rotate about the pivot 173 in a clockwise direction, indicated by the Arrow D in FIG. 5, thus engaging the locking end 176 with the bolt 25 for preventing movement of the bolt 25 due to the expanding gases.

The moments 125 and 126 of the rotating arm 124 are operatively configured to rotate the valve 116 in the direction of Arrow B to move valve 116 to the second or closed position far enough past tube 115 to move linkage 132 in the direction of Arrow C, such that, when the valve 116 is moved back to the first or open position, the breach bolt block 170 is moved clear of the bolt 25 prior to the valve 116 allowing any of the gases with the chamber 111 to release from the chamber 111. The present embodiment is one exemplary example of how using just simple mechanical linkages this may be accomplished. It should be appreciated that in other various exemplary embodiments, other methods may be employed to ensure the breach bolt block is clear of the bolt prior to the release valve releasing the gases, for example, electrically or the use of computers, may be used.

Now referring to FIG. 7, the power supply 150 for the device 100 is controlled by the shooter through the micro switch 152 and the on/off switch 154. The power supply 150 of the present invention is a nine volt battery. However, it should be appreciated that in other various exemplary embodiments, other types of power supplies common in the art may be used.

The micro switch 152 is electrically connected to the power supply 150 and the solenoid 140. The micro switch 152 in the present embodiment is disposed within the trigger assembly 25. In particular, the micro switch 152 is disposed in a trigger guard 21 and operably configured to be engaged by a trigger 20. Further, the micro switch 152 is operably configured to complete the electrical circuit to the solenoid 140 when the shooter takes up the slack in the trigger 20. However, it should be appreciated that in other various exemplary embodiments, the micro switch could disposed at other locations on the rifle such that the shooter can use a finger or hand pressure to operate the micro switch.

In the present embodiment, the micro switch 152 is operably configured to complete the electrical circuit with the solenoid prior to firing the cartridge in the rifle 10. Once the micro switch 152 completes the circuit, electrical power is supplied from the power supply 150 to the solenoid 140. The solenoid 140 actuates the solenoid plunger 141 and moves the linkage assembly 130. The linkage assembly 130 in turn moves the release valve 116 to the closed position and the bolt breach block to the locked position.

As long as the shooter maintains pressure on the trigger 20 and thence the micro switch 152, the gases are stored in the chamber 111. The solenoid 140 via the linkage 130 and the breach bolt block 170 keeps the bolt 25 locked by engaging the breach bolt block 170 and thus the Action of the rifle 10 is halted. After the shooter releases the trigger 20, the micro switch 152 releases and opens the electrical circuit to the solenoid. The solenoid 140 in turn retracts the linkage assembly 130. The linkage assembly 130 first moves the bolt breach block 170 to the non-engaged position and second moves the release valve 116 to the open position. Once the release valve 116 opens, the gases stored in the chamber 111 are release through the outlet port 115 and nozzle 117 into the action port tube 18. The rifle 10 is then free to complete the Action that was halted by the action delay device 100.

The on/off switch 154 in the present embodiment is a slide type switch and is disposed on the stock 15 such that the shooter's shooting hand thumb can activate the on/off switch 154. In the present embodiment, when the on/off switch 154 is in the off position, the the solenoid 140 is placed in the retracted position moving the gas release valve 116 to the open position and the breach bolt block 170 to the non-engaged position. It should be appreciated that in other various embodiments the on/off switch could be of other types common in the art and dispose at other locations on the rifle.

The action delay device 100 allows the shooter to delay the action of the semi-automatic rifle 10, thus eliminating movement of the rifle 10 caused by the breach bolt assembly 16 movement. The delay created by the device 100 allows the shooter to maintain aim on the target thus increasing accuracy while maintaining the ability for rapidity of fire at the shooter's discretion.

Figure 8:
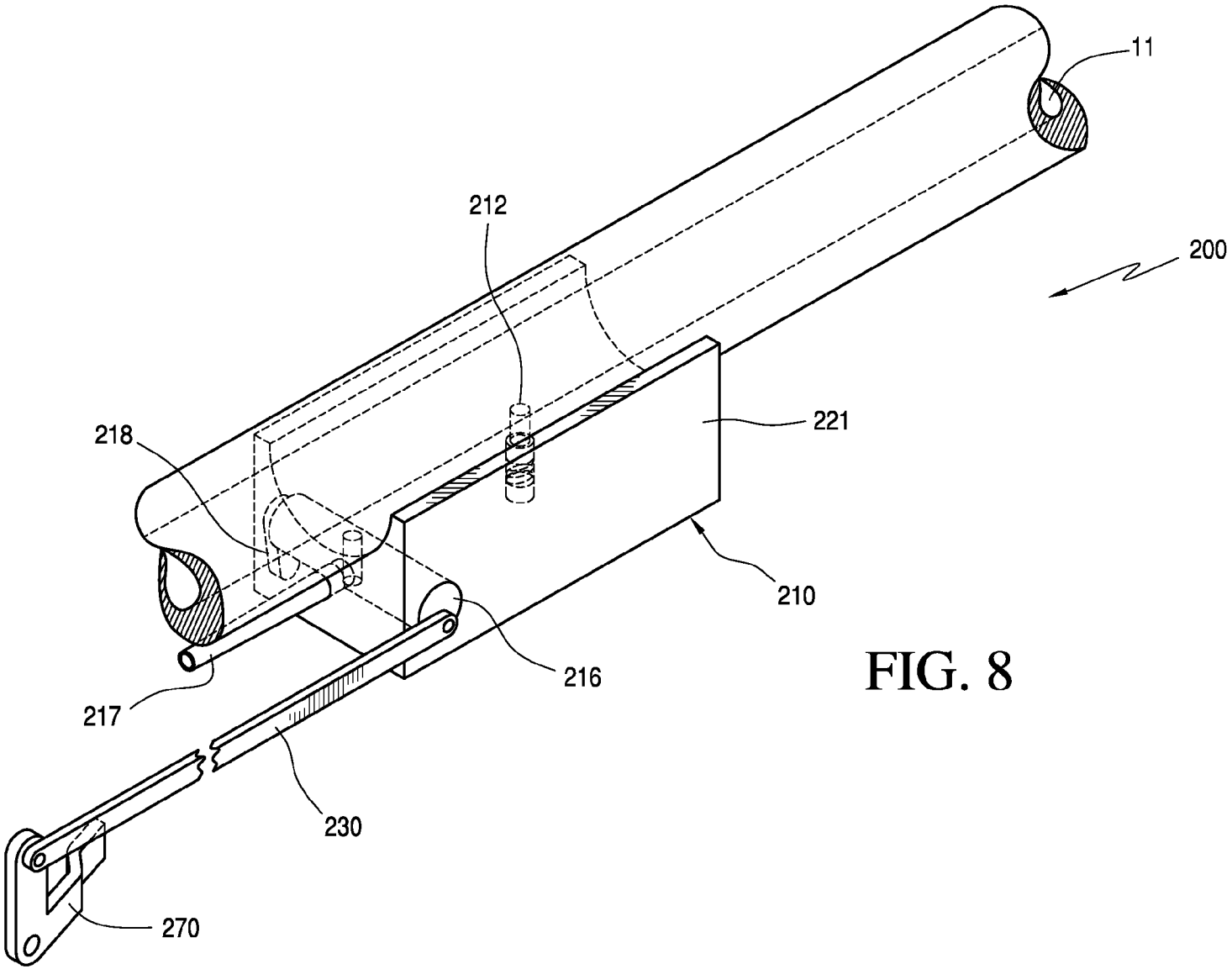
FIG. 8 is a perspective view of an alternative embodiment of the device made in accordance with the present invention.

FIG. 8 displays perspective view of a semi-automatic rifle delay device 200. The device 200 is an alternative embodiment of a action delay assembly device 100 made in accordance with the present invention. The device 200 is similar to the device 100 described above. The device 200 includes a container 210, a chamber (not shown), a bolt breach block assembly 270, a linkage assembly 230 and a release valve 216. The devise 200 also includes a barrel port 212, a one way valve 214, an outlet port 215 and a release valve 216. The device 200 is disposed on a firearm as is the device 100, wherein the firearm includes a breach bolt assembly 16, a barrel 12 and a bore 11, as in the rifle 10.

One difference in the device 200 from that of the device 100, for example, is the lack of a solenoid and power supply. In fact the device 200 requires no electrical power. The release valve 216 is operably configured such that the release valve 216 is operated by a hand of the shooter.

The release valve 216 includes a lever 218. As the shooter turns the lever 218, the valve 216 rotates the linkage assembly 230, which in turn releases the bolt breach block assembly 270 and as the release valve 216 is pushed further, the release valve 216 opens and the gases in the chamber of the container 210 escape through a nozzle 217 and act upon the breach bolt assembly 16 normally.

Figure 10:
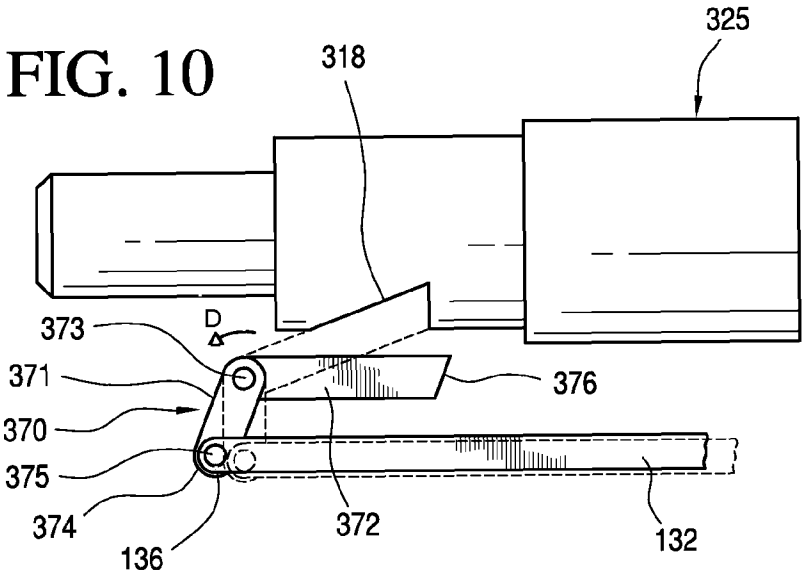
FIG. 10 is a side view of the breach bolt block of FIG. 9.
Figure 11:
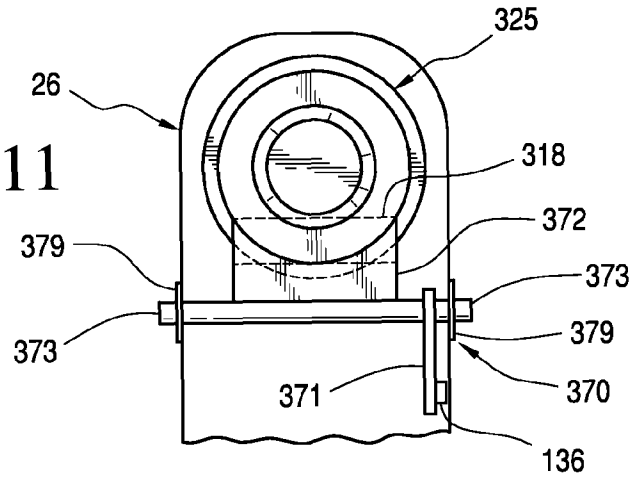
FIG. 11 is an end view of the breach bolt block of FIG. 9.
Figure 9:
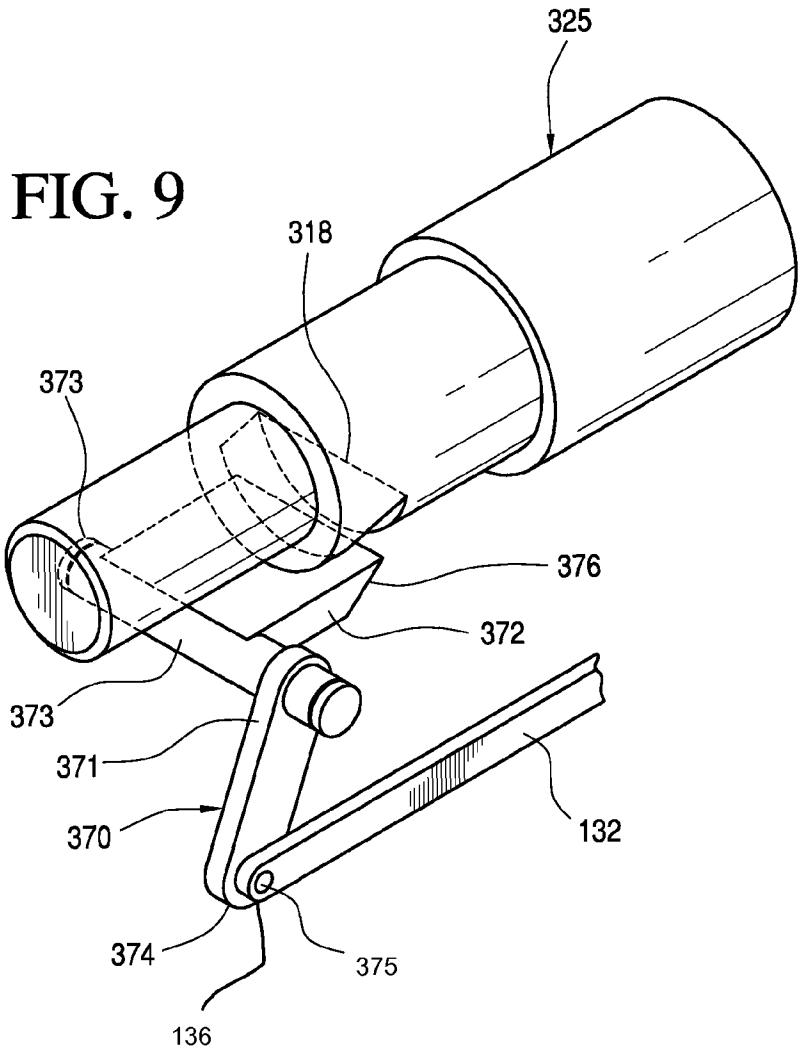
FIG. 9 is a perspective view of an alternative embodiment of a breach bolt block.

FIGS. 9, 10 and 11 show an alternative embodiment of a breach bolt block assembly 370 made in accordance with the present invention for use on the rifle 10 with the action delay device 100 and 200. The breach bolt block 370 is similar to the breach bolt block assembly 170. The bolt block 370 is operably configured to engage the breach bolt assembly 16 of the rifle 10. The bolt 375 is the same as the bolt 25, except the bolt 325 includes a notch 318.

Similar to the breach bolt block 170, the breach bolt block assembly 370 has two positions, an engaged position and a disengaged position. The engaged position of the breach bolt block 370, as shown in FIG. 9, is indicated by the dashed lines. The solid lines of the breach bolt block assembly 370 in FIG. 9 represent the non-engage position. The breach bolt block 370 is operably configured to stop the reward motion of the bolt 325 when the block 370 is in the engaged position. In the present embodiment, the breach bolt block 370 is in the engaged position when the gas release valve 116 is in the closed position.

The breach bolt block assembly 370 includes a first member 371, a second member 372 and a pivot member 373 as shown in FIGS. 9, 10 and 11. The first member 371 has a first end 374 and a post 375. The second end 136 of the second linkage 132 of the delay action device 100 is rotatably engaged to the post 375.

The breach bolt block assembly 370 is different from the breach bolt block assembly 170 in that the bolt block assembly 370 does not have a pivot, but rather the pivot member 373. In the present embodiment, the pivot member or rod 373 is rotatably attached to the receiver assembly 13. The pivot rod 373 extends from a first side of the receiver assembly 13 to a second side of the receiver assembly 13, as shown in FIG. 11. The pivot member 373 is retained in the receiver assembly 13 by retainer 379. In the present embodiment the retainer 379 is a spring clip. However, it should be appreciated the in other various exemplary embodiments, other retaining devices common in the art may be used.

The second member 372 of the breach bolt block assembly 370 is fixedly attached to the pivot member 373 and includes a second end 376. The second end 376 is operably configured to be generally parallel to the notch 318 of the bolt 325 when the breach bold block assembly 370 is in the engaged position.

When in operation, the micro switch 152 makes contact and the electrical circuit to the solenoid 140 is complete. The solenoid 140 via the linkage assembly 130 rotates the valve 116 to the closed position and the bolt block assembly 370 is rotated about the pivot rod 373 in a counterclockwise direction, as indicated by Arrow D to the engaged position. The counterclockwise rotation of the bolt block assembly 370 rotates the pivot pin 373 and moves the second end 376 into the notch 318. The bolt 325 is blocked from traveling.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A device for delaying the action of a gas action operated firearm having a barrel with a bore, an action tube and a bolt block comprising:

a container having a gas chamber and an outlet, wherein the outlet is in fluid communication with the action tube of the firearm;

a port in fluid communication between the gas chamber and the bore of the barrel;

a one-way check valve in the port, wherein the one-way check valve permits the fluid flow from the bore to the gas chamber;

a gas release valve having at least an open and a closed position, disposed on the container and in fluid communication with the gas chamber and the outlet; and, linkage rotatably attached to the gas release valve and in mechanical communication with the bolt block, wherein when the gas release valve is in the closed position, gas is retained in the gas chamber and the linkage blocks the bolt block from moving, and when the gas release valve is in the open position the linkage unblocks the bolt block permitting normal gas action of the firearm.

2. The device for delaying the action of a gas action operated firearm, as recited in claim 1, wherein the container is disposed on the firearm.

3. The device for delaying the action of a gas action operated firearm, as recited in claim 2, wherein the container is disposed on the barrel.

4. The device for delaying the action of a gas action operated firearm, as recited in claim 1, further comprising a nozzle disposed on the outlet and the nozzle is in fluid communication with the action tube of the firearm.

5. The device for delaying the action of a gas action operated firearm, as recited in claim 1, further comprising a solenoid disposed on the rifle, wherein the solenoid has a power supply, an on/off control and linkage to the gas release valve.

6. The device for delaying the action of a gas action operated firearm, as recited in claim 5, further comprising a micro switch, wherein the micro switch controls the release of the solenoid.

7. The device for delaying the action of a gas action operated firearm, as recited in claim 6, wherein the micro switch is operated by movement of a trigger on the rifle.

8. The device for delaying the action of a gas action operated firearm, as recited in claim 5, wherein the solenoid is mounted to the barrel.

9. The device for delaying the action of a gas action operated firearm, as recited in claim 5, wherein the firearm has a stock and the power supply is a nine volt battery disposed in the stock.

10. The device for delaying the action of a gas action operated firearm, as recited in claim 1, wherein the gas release valve is electrically controlled between the open and closed positions.

11. The device for delaying the action of a gas action operated firearm, as recited in claim 1, wherein the container is made of steel.

12. A gas action delay device, comprising:

a container having a gas chamber, an output port and an input port, wherein the input port includes a one-way check valve and is operably configured to receive a gas input;

a valve disposed on the container, having at least an open and closed position, and being in fluid communication with the output port and the gas chamber, wherein when the valve is in the closed position, gas is retained in the gas chamber and when the valve in the second position, the gas is released through the output port;

linkage having a first and second end, wherein the first end is rotatably attached to the valve; and, a blocking member in mechanical communication with the second end of the linkage and having at a first and second position, wherein when the valve is in the closed position, the blocking member is in a blocking position and when the valve is in the open position, the blocking member is rotated by the linkage to an unblock position.

13. The gas action delay device, as recited in claim 12, wherein the container is made of steel.

14. The gas action delay device, as recited in claim 12, further comprising a solenoid, wherein the solenoid has a power supply, an on/off control and linkage rotatably connected to the valve.

15. The gas action delay device, as recited in claim 12, the valve is electrically controlled between the open and closed positions.

16. An action delayed device for attaching to a gas action operated semi-automatic rifle having a barrel, an action tube, a bolt breach assembly and a receiver assembly comprising:

a gas capture chamber disposed on the barrel;

a port in fluid communication between the gas capture chamber and the barrel;

a one-way check valve in the port, wherein the one-way check valve permits the gas flow from the barrel to the gas capture chamber;

a gas release valve having at least an open and a closed position disposed on the gas capture chamber;

a nozzle disposed on the gas release valve;

a gas line attached to the nozzle and in fluid communication with the action tube of the rifle;

a linkage assembly having first and second ends, wherein the first end is rotatably attached to the gas release valve; and, a bolt delay mechanism disposed on the receiver assembly and rotatably attached to the second end of the linkage assembly, wherein when the gas release valve is in the closed position, the bolt delay mechanism is in a bolt breach assembly delay position and when the gas release valve is in the open position, the bolt delay mechanism is rotated by the linkage to a bolt breach assembly free position permitting the bolt breach assembly to execute normal action.

17. The action delayed device, as recited in claim 16, wherein the one-way check valve is a piston and spring type check valve.

18. The action delayed device, as recited in claim 16, further comprising a solenoid disposed on the barrel, wherein the solenoid has a power supply, an on/off control and linkage in mechanical communication with the gas release valve.

19. The action delayed device, as recited in claim 18, wherein the power supply is a nine volt battery.

20. The action delayed device, as recited in claim 18, further comprising a micro switch and the rifle includes a trigger, wherein the micro switch is operated by the trigger and controls the release of the solenoid, wherein, when in use the gas capture chamber captures and stores the gases from a fired rifle not allowing the action to reload the rifle, when the micro switch is activated the solenoid moves the linkage, the bolt block mechanism and the gas release valve releasing the stored gases and permitting the action to operate.

21. A rifle comprising:

a stock;

a receiver assembly connected to the stock, wherein the receiver assembly includes a gas activated bolt breach assembly having an action tube, and a trigger assembly;

a bolt block assembly disposed on receiver assembly a barrel connected to the gas activated bolt breach assembly;

a gas chamber disposed on the barrel;

a port in fluid communication between the gas chamber and the barrel;

a one-way check valve in the port, wherein the one-way check valve permits the fluid flow from the barrel to the gas chamber;

a gas release valve disposed on the gas chamber;

a nozzle disposed on the gas release valve and in fluid communication with the action tube of the gas activated bolt breach assembly;

a linkage assembly having first and second ends, wherein the first end is rotatably attached to the gas release valve; and, a bolt delay mechanism disposed on the receiver assembly and rotatably attached to the second end of the linkage assembly, wherein when the gas release valve is in the closed position, the bolt delay mechanism is in a bolt breach assembly delay position and when the gas release valve is in the open position, the bolt delay mechanism is rotated by the linkage to a bolt breach assembly free position permitting the gas activated bolt breach assembly to execute normal action.

22. The rifle, as recited in claim 21, further comprising a solenoid disposed on the rifle, wherein the solenoid has a power supply, an on/off control disposed within the stock and linkage in mechanical communication with the gas release valve, wherein, when in use the gas chamber captures and stores the gases from a fired rifle not allowing the action to reload the rifle, when the micro switch is activated the solenoid moves the linkage, the bolt delay mechanism and the gas release valve releasing the stored gases and permitting the action to operate.

23. The rifle, as recited in claim 21, wherein the rifle is semi-automatic.

* * * * *